United States Patent [19]

Soble

[11] 4,198,797

[45] Apr. 22, 1980

[54] METHOD AND FIXTURE FOR LATERAL AND LONGITUDINAL POSITIONING OF MOBILE OR MODULAR HOME UNITS

[76] Inventor: Bernard D. Soble, 19151 Berkley Ave., Detroit, Mich. 48221

[21] Appl. No.: 901,539

[22] Filed: May 1, 1978

[51] Int. Cl.[2] ..... E04H 1/12; E02D 27/32; B65G 7/02

[52] U.S. Cl. ..... 52/299; 52/745; 52/749; 254/84; 254/93 R; 414/12

[58] Field of Search ..... 52/745, 749, 143, 299; 214/1 H; 254/84, 93 R

[56] References Cited

U.S. PATENT DOCUMENTS

| | | | |
|---|---|---|---|
| 3,789,558 | 2/1974 | Spencer | 52/749 |
| 3,817,401 | 6/1974 | Becker | 414/12 |
| 3,874,639 | 4/1975 | Wilson | 254/100 |
| 3,879,050 | 4/1975 | Young | 214/1 H |
| 4,007,568 | 2/1977 | Soble | 52/294 |

*Primary Examiner*—John E. Murtagh
*Attorney, Agent, or Firm*—Krass & Young

[57] ABSTRACT

A method and fixture for lateral and longitudinal positioning of mobile home or modular housing units on the foundation site is disclosed, particularly related to positioning more than one module sometimes referred to as double wide or other structural units, such as modular subunits with respect to each other incidental to assembly operations. The method includes the procedure of initially installing one of the double wide or other structural unit on a foundation including a plurality of stanchions, positioning a second structural unit adjacent the position of the first structural unit with a clearance space therebetween for carrying out steps preparatory to joining of the units, the second unit being positioned on a series of temporary cross beams supported on the foundation stanchions and engaging the structural units underframe members. The second structural unit is shifted laterally and longitudinally into position against the first unit enabling the units to be joined together after the temporary cross beams have been removed and the second unit then secured to its foundation stanchions. The fixture includes a pair of rails having an adjustable position spacer tube and bolt assembly extending therebetween and adapted to engage a foundation stanchion or other fixed member so as to provide a reaction point for a jack mounted in bracketry secured to the opposite end of the rails, the jack positioned to engage the end of temporary cross beams and force the mobile home positioned on the cross beam laterally towards the previously installed first unit. The laterally extending rails are progressively advanced after successive adjustments of the unit equal to the stroke of the jack to allow relatively short stroke jacking mechanisms to be utilized to move the unit a distance on the order of less than one foot to more than three feet. A pair of fixtures and jacks are utilized simultaneously to allow a simultaneous shifting of the front and rear of the unit. Lengthwise or longitudinal adjustment of the position of the unit is also contemplated by means of direct engagement of the jack fixtures with the longitudinally extending underframe members. This method and fixturing facilitates controlled shifting of the lateral position of the unit without imposing stresses on the mobile home structure.

7 Claims, 7 Drawing Figures

Fig-2
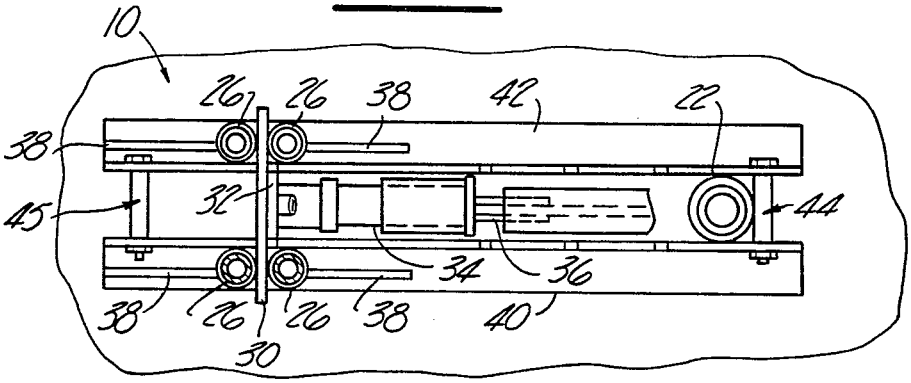
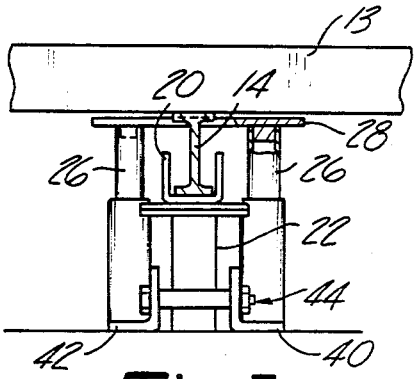
Fig-3
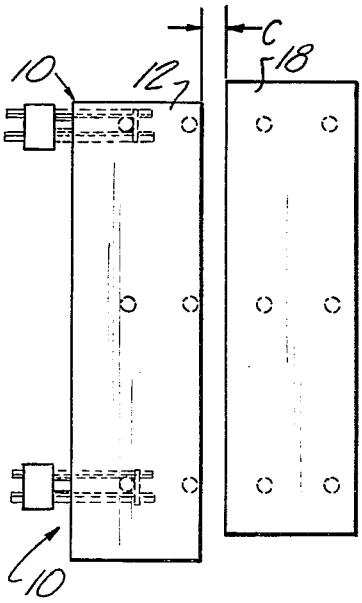
Fig-4
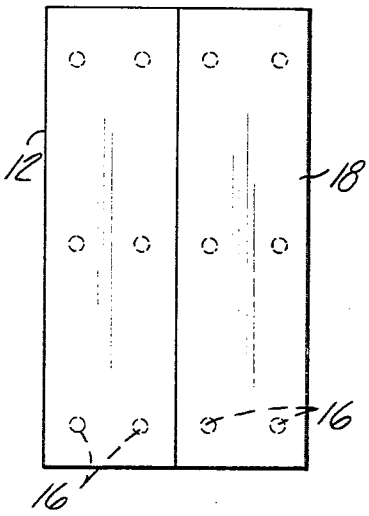
Fig-7
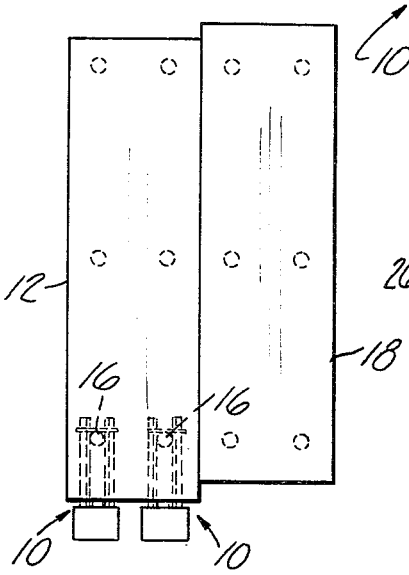
Fig-5
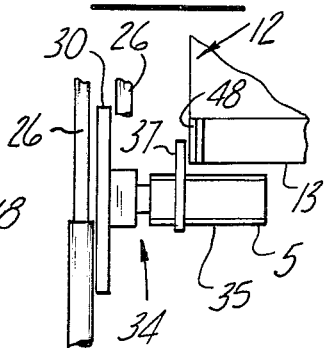
Fig-6

METHOD AND FIXTURE FOR LATERAL AND LONGITUDINAL POSITIONING OF MOBILE OR MODULAR HOME UNITS

BACKGROUND OF THE INVENTION

1. Field of the Invention

This invention concerns installation of mobile home structures and more particularly, the installation of mobile home structures comprised of a plurality of modular units which necessitates the lateral positioning of the units to align the same together for joining into a unitary structure.

2. Description of the Prior Art

Manufactured housing including "mobile" and modular-type manufactured housing has enjoyed considerable growth in recent years due to the great and pressing need for low cost residential shelter structures. Notwithstanding this relatively great growth, foundation arrangements and installation procedures for modular or mobile home units has remained relatively primitive. This is in part due to the origins of the industry, i.e., in the trailer or truly "mobile" home-type construction in which the unit was moved relatively often, and hence was emplaced in a relatively temporary fashion at each site. In most cases this emplacement was no more than putting the mobile home "on blocks," i.e., concrete block piers in which the trailer was jacked up and piles of concrete blocks were stacked beneath the mobile home frame to provide a platform. As the mobile home industry has evolved into a mass producer of low cost shelter structures, the foundation arrangements have not truly kept pace, as described in U.S. Pat. No. 4,125,975, which is a continuation-in-part of Ser. No. 556,969 filed Mar. 10, 1975.

The existing foundation arrangements have a great number of disadvantages in that there is not provided adequate resistance to overturning forces, the mobile home is typically supported at a relatively high position above the ground increasing the wind overturning forces and creating aesthetically unpleasing ground clearance necessitating the use of skirting. In addition, the support arrangements do not provide adequate resistance to shifting of the foundations by mud, freeze and thaw conditions, etc. In the aforementioned applications there is disclosed an improved foundation arrangement consisting of a plurality of telescoping stanchions which are mounted within the ground or above the ground in such a way as to be laterally stabilized, i.e., to be securely positioned against skewing movements of the stanchion, so that the stanchions telescope properly during installation thereof by being maintained in substantial parallel alignment with each other. This arrangement also precludes the imposition of distorting stresses on the mobile home frame which could be induced by skewing movements of the piers. This foundation arrangement has been found to be very advantageous and provides a superior, yet relatively low cost foundation structure which very admirably is suited to the low cost mass marketing structure involved in the mobile home business.

The platform support arrangements of the prior art led to certain difficulties in positioning and assembly of mobile home or modular housing structures with respect to each other at the site. These units are commonly shipped or transported in halves with the exposed or open end covered with plastic sheeting material, and at the site one of the units is placed on the platform, the other unit positioned with a clearance space therebetween sufficient to allow workmen to prep the units, i.e., to remove the plastic and make the necessary connections, etc. One of the mobile home units is then shifted into final position by the use of inclined jacks acting on a mobile home structure which acts upwardly and laterally on the mobile home structure to "shove" the mobile home over to the other unit and onto some suitably located vertical piers. The entire operation is difficult to control and time consuming to execute. In addition, it commonly imposes severe stresses on the mobile home structure which oftentimes results in damage to the structure. Furthermore, accidents are common due to inadvertent shifting of the mobile home structure.

It is thus an object of the present invention to provide a means for lateral positioning of mobile home structures on a foundation site.

It is another object of the present invention to provide such capability in which the movement of the mobile home structure can be precisely controlled.

It is yet another object of the present invention to provide a method and arrangement for laterally positioning a mobile home structure which does not impose excessive stresses on the mobile home structure.

It is still a further object of the present invention to provide such a method and arrangement which enables rapid and fail-safe positioning of respective units of modular or mobile home double wide units together in position to enable joining together of the units into a unitary structure.

SUMMARY OF THE INVENTION

These and other object which will become apparent upon reading of the following specification and claims is accomplished by provision of fixturing allowing a horizontally acting jack to engage either transversely disposed temporary support beams carried on the foundation stanchions, or to directly engage the mobile home underframe members for adjustment along a longitudinal axis of the mobile home. The fixturing includes a pair of rails positioned to straddle one of the foundation stanchions and also includes spacer tube and bolt assembly extending across the rails and abutting the stanchion to absorb the reaction forces created by engagement of the jack with the mobile home during positioning movements. The rails are provided with a series of holes or notches to provide for progressive shifting of the spacer tube as the mobile home is shifted laterally so that a multiple of the distance of the jack's stroke can be accommodated by the arrangement. In the method of installation, a first double wide or modular unit is initially installed on the foundation, the second unit then positioned with a clearance space therebetween to allow prepping operations, with the second modular or double wide unit then being inched into final abutting position by use of the fixturing described. The temporary support beams are removed and the second modular or double wide unit then permanently secured to the foundation stanchions in the final joined position.

BRIEF DESCRIPTION OF THE DRAWINGS

FIG. 2 is a plan view of the fixturing depicted in FIG. 1 showing the relationship with the telescoping stanchion.

FIG. 3 is an endwise elevational view of a temporary support beam and fragmentary depiction of the mobile home underframe and telescoping stanchion.

FIG. 4 is a plan diagrammatic view of the modular units, shown in FIG. 1, showing a pair of fixture arrangements simultaneously engaging the unit to be positioned by sideways or lateral movement of the unit into position with the other unit.

FIG. 5 is a diagrammatic representation showing the positioning of a double wide or modular unit in an offset spaced position in the longitudinal direction, with the fixture arrangments positioned to produce an endwise or longitudinal adjustments of one of the units into position with the other unit.

FIG. 6 is a partially sectional view of the fixturing in endwise engagement with the mobile home as depicted diagrammatically in FIG. 5.

FIG. 7 shows a plan view of the final position of the double wide units in their abutting or joined position.

DETAILED DESCRIPTION

Figure 1:
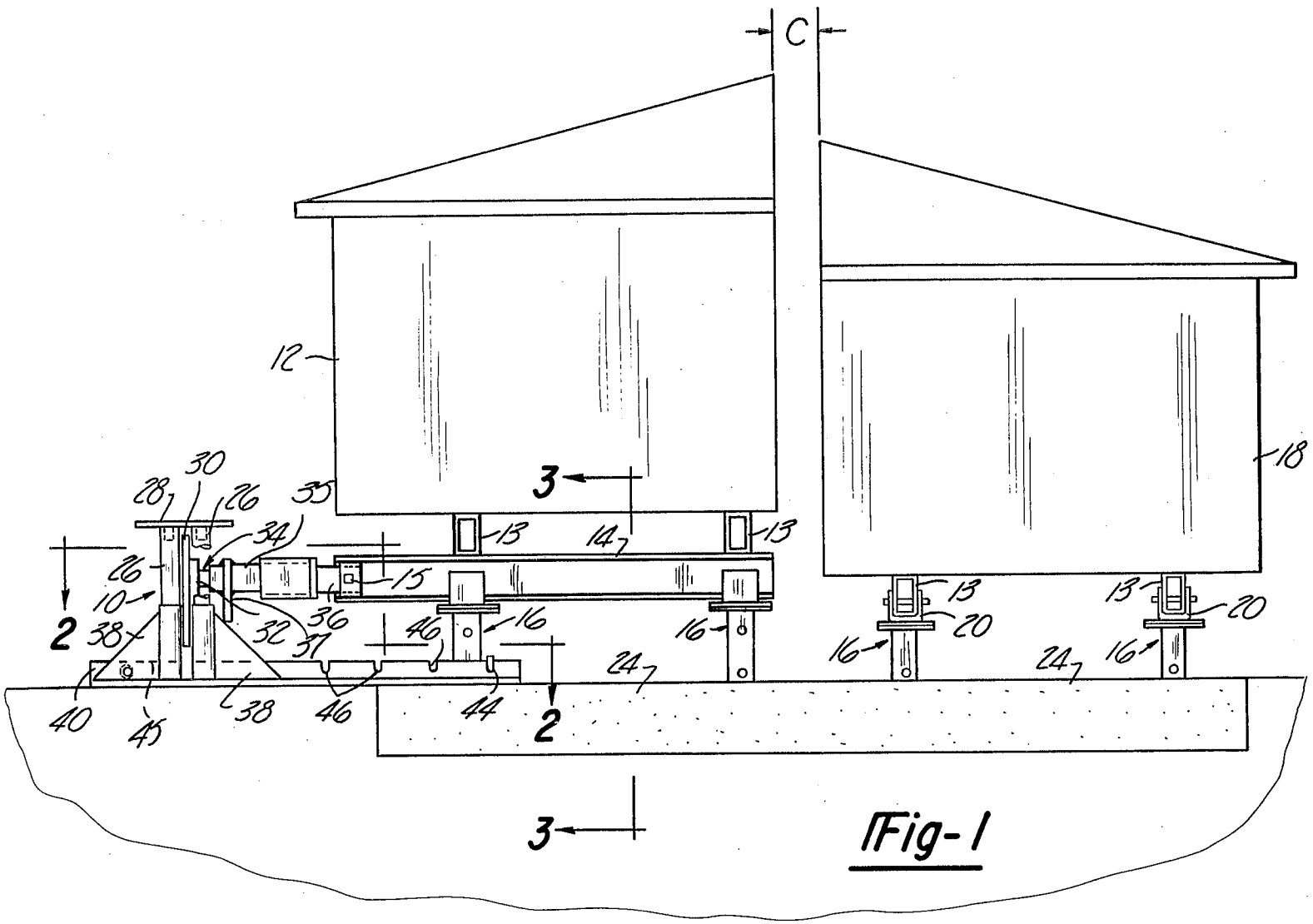
FIG. 1 is a side elevational view of a fixture according to the present invention shown in position with respect to a foundation stanchion in engagement with a temporary support beam upon which a mobile home underframe rests.

In the following Specification and Drawings, particular terminology will be utilized for the sake of clarity and a specific embodiment described in accordance with the requirements of 35 USC 112, but it should be understood that the same is not intended to be limiting, and should not be so construed, inasmuch as the invention is capable of taking many forms and variations within the scope of the appended claims.

Referring to FIGS. 1 and 2, the fixture 10 according to the present invention is depicted, positioned for lateral adjustment of the position of a mobile home 12, in such situations as normally occur in positioning double wide units side by side. In the sideways or lateral adjustment mode, the mobile home 12 is positioned with the I-beam or box beam support frame members 13 supported on a plurality of transverse temporary support beams 14. The temporary support beams 14 are in turn supported on telescoping stanchion assemblies 16 of the type described in the above referenced copending application, U.S. Pat. No. 4,125,975. The mobile home 12 shown has previously been moved into approximate fore and aft juxtaposition with a second mobile home unit 18 or other modular unit, which in turn has been installed on the foundation arrangement, as described in the above identified copending application. This installation as shown in FIG. 1 includes securing the frame members 13 to U-brackets 20 by the procedure outlined in that application.

The mobile home 12 is initially elevated by a plurality of jacks, the running gear removed, and the transverse temporary support beams 14 then placed in position, with the mobile home 12 then being lowered by the jacks onto temporary support beams 14, to be in the position shown in FIG. 1.

Typically, a minimum of six pairs of the telescoping stanchion assemblies 16 are required to provide support for the mobile home unit 12, and a temporary cross beam 14 is positioned across each such pair.

The telescoping stanchion assemblies 16 provide for raising and lowering of the stanchions 22 by virtue of being received within casings, either mounted below the slab 24, forming a part of the foundation arrangement, or which are supported above the slab surface, so as to accommodate the up and down movement of the mobile home units during the installation procedures.

The stanchion assemblies 16 each include the U-brackets 20 which in the final installed position, as shown with mobile home unit 18, receives a unit underframe beam 13 and is bolted or otherwise fastened to secure the mobile home unit to the stanchion assembly 16.

However, during the method of lateral positioning of the mobile home unit 12 contemplated by the present invention, the stanchions 22 are rotated so as to dispose the U-brackets 20 to receive the temporary cross beams 14, as shown in FIG. 3, The mobile home 12 is initially positioned with a clearance space C, as shown, to enable access for steps preparatory to assembly to be carried out, i.e., the removal of plastic sheeting, etc., so that the mobile home unit is positioned offset (as shown) with respect to the stanchion assemblies 16 from their final installed position.

According to the arrangement of the present invention, the fixture 10 includes four posts 26 joined at their upper end with a cap member 28 and slidably receiving a base plate 30 which has formed therein a base receiving bracket 32 adapted to receive jacking means such as an hydraulic cylinder 34 so as to be retained therein. Thbe hydraulic jack when in position in the bracket 32 has a jacket 35 which extends horizontally and is equipped with a fork bracket 36 adapted to straddle the central web of the temporary cross beam 14 to insure a secure engagement of the jack with the cross beam. A plurality of gussets 38 are provided which act as braces to receive the thrust of the jack at the corners and transmit the same into a pair of rails 40, 42.

The rails 40 and 42 extend beneath the mobile home structure 12 and straddle the outboard stanchion assembly 16 with a pair of spacer tubes and bolt assemblies 44 and 45 positioning the rails 40 and 42 with respect to each other, the inside spacer tube and bolt assembly 44 being also adapted to engage the back surface of the stanchion assembly 16, so as to absorb the thrust of the jack which is transmitted into the rails 40 and 42. The jack assemblies 34 are often of a relatively short stroke relative to the clearance space C, and also some variation in the width of the units is normally encountered which would require adjustability in the length of the rails 40 and 42 with respect to the distance to the inside spacer tube and bolt assembly 44 from the jack support structure. Accordingly, a plurality of openings 46 are provided along the lengths of the rails 40 and 42 to adapt the fixturing of the various configurations and also allow the progressive lateral cycling of the jack elements within the stroke limitations of the jack 34 by successively placing the spacer tube and bolt assembly 44 in progressively closer openings 46.

As noted, after positioning of the second mobile home unit 12 in proximity to the previously installed first mobile home 18, jacking mechanisms are positioned to elevate the second mobile home unit 12 sufficiently to remove the temporary cross beam 14 and lower the unit so as to position the underframe members 12 within the U-brackets 20 which have been rotated in order to receive the same, as shown, with the box beam then being secured thereto so that in the final position the unit 12 is in position in abutment with the mobile home unit 18, as shown.

Referring to FIG. 4, the plan view of the mobile home units is shown, in the first or initial position in which the mobile home unit 12 has been positioned in juxtaposition with respect to the mobile home unit 18 with a clearance space C provided to enable access thereto. Since three or more sets of stanchion assemblies 16 are normally provided, temporary support beams 14 are located at each pair, but only two jacks and fixture assemblies 10 need be employed to carry out the lateral shifting of position of the mobile home unit 12, as shown in FIG. 4. The final lateral position of the mobile home units 12 and 18 is diagrammatically represented in FIG. 5.

The fixture arrangement 10 may also be utilized to provide longitudinal adjustment of the relative position of the mobile home unit 12 where a lengthwise adjustment is necessary as indicated in FIG. 5. This could be accomplished by positioning the fixtures in alignment with the respective underframe beams while straddling one of the stanchion assemblies 16 in similar fashion. In this case, the fixturing would be adapted to transmit the force exerted by the mechanism into the I-beams 13 in order to carry out the position adjustment. As shown in FIG. 6, the mode of engagement would be by means of a lip 37 welded to jacket 35 engaging the fascia 46 overlaying the end of the beams 13. In this situation, some adjustability in the vertical height of the jack 34 may be necessary and is provided in the fixturing by the slidability of the base plate 30 within the four posts 26 to accommodate the different height of the I-beam 13 above the slab surface. The final adjustment of the units 12 and 18 is shown diagrammatically in FIG. 6.

This arrangement could also be utilized in single unit installation situations where some final slight adjustment in the position of the mobile home becomes necessary.

Accordingly, it can be seen that a relatively simple procedure and fixture has been provided which allows controlled positioning of the units vis-a-vis each other without imposing harmful stresses on the mobile home structure since the positioning forces are absorbed by either the frame members, or the temporary support beams.

The embodiments of the invention in which an exclusive property or privilege is claimed are defined as follows:

1. A fixture arrangement for laterally adjusting the position of a structure with respect to fixed foundation members, said fixture comprising: jacking means including an output member adapted to be moved to exert a positioning force; fixture means including a bracket supporting said jacking means to exert said positioning force along a horizontal direction; a temporary support beam disposed on a pair of said foundation members and on which said structure is adapted to be directly disposed; means producing shifting movement of said temporary support beam and said structure carried thereby in response to operation of said jacking means; rail means drivingly connected to said jacking means and adapted to extend into engagement with one of said foundation members beneath said structure to resist the reaction force generated by said jacking means, whereby said temporary beam may be shifted with said structure directly supported thereon by said jacking means.

2. The fixture adjustment arrangement according to claim 1 wherein said jacking means includes a hydraulic jack.

3. The fixture arrangement according to claim 1 wherein said beam comprises an I-beam and wherein said means producing movement of said structure includes a fork member engaging the central web portion of said I-beam.

4. The fixture arrangement according to claim 1 wherein said foundation members comprise stanchion members rotatably supported and further includes U-bracket means positioned at the upper end of said foundation members and wherein said temporary beam supporting said structure is disposed during said positional adjustment in said U-brackets whereby said temporary beam is guided therein.

5. The fixture arrangement according to claim 1 wherein said rail means comprises a pair of rail members extending in straddling relationship with at least one of said foundation members.

6. The fixture arrangement according to claim 5 wherein said rail means further comprises a spacer tube means in engagement with said foundation member and connecting said rail means at a point remote from said fixture means.

7. The fixture arrangement according to claim 6 further including means for progressively positioning said spacer tube means at successive longitudinal locations along said rail means, whereby said stop member may be located successively closer to said structure outer edge, as said jacking means moves said structure towards said foundation member.

* * * * *